US006098491A

United States Patent [19]

Carlson et al.

[11] Patent Number: 6,098,491

[45] Date of Patent: Aug. 8, 2000

[54] CONTROL LEVER ASSEMBLY WITH HANDLE LOCK-OUT

[75] Inventors: David Carlson, Hillside, Ill.; Mark R. Coppley, Garner; Michael S. Johnston, Clayton, both of N.C.; David P. Smith, Joliet, Ill.

[73] Assignee: Caterpillar Inc., Peoria, Ill.

[21] Appl. No.: 09/179,800

[22] Filed: Oct. 27, 1998

[51] Int. Cl.[7] ..... G05G 5/06

[52] U.S. Cl. ..... 74/527; 74/473.23; 74/529

[58] Field of Search ..... 74/527, 529, 473.21, 74/473.23; 70/201, 247

[56] References Cited

U.S. PATENT DOCUMENTS

| | | | |
|---|---|---|---|
| T973,003 | 8/1978 | Kelly et al. | 70/200 |
| 2,631,704 | 3/1953 | Wiess | 192/8 |
| 3,543,603 | 12/1970 | Gley | 74/527 |
| 3,795,152 | 3/1974 | Campbell | 74/471 R |
| 4,220,050 | 9/1980 | Friesen et al. | 74/2 |
| 4,770,057 | 9/1988 | Foggini | 74/527 |
| 5,129,282 | 7/1992 | Bassett et al. | 74/529 |

*Primary Examiner*—David M. Fenstermacher
*Attorney, Agent, or Firm*—Haverstock, Garrett, and Roberts

[57] ABSTRACT

A control lever assembly with handle lockout capability including a lever element selectively positionable in a locking position and lockable therein by movement of a handle thereof to a lock position. A first biasing member is disposed on the lever element in an operative position to exert a first biasing force against a detent element, and a second biasing member is disposed in opposition to the first biasing member and is operable to hold the detent element to allow free pivotal movement of the lever element relative to a base.

6 Claims, 3 Drawing Sheets

CONTROL LEVER ASSEMBLY WITH HANDLE LOCK-OUT

TECHNICAL FIELD

This invention relates generally to control levers requiring a lock-out capability for preventing inadvertent and accidental actuation of systems controlled thereby, and more particularly, to a control lever assembly having a handle lock-out capability that provides tactile feed-back of the locked out condition as well as a variety of failure conditions.

BACKGROUND ART

Currently, lock-out features for control levers operable for controlling critical functions of machines utilized in such industrial fields as agriculture, construction and excavating, mining, forestry, and the like, include external mechanisms, hydraulic circuitry, and/or internal mechanisms operable using a separate lever or other actuating member.

Reference Campbell U.S. Pat. No. 3,795,152 issued Mar. 5, 1974 to Caterpillar Tractor Co.; Kelly et al U.S. Defensive Publication No. T973,003 issued Aug. 1, 1978 to Caterpillar Tractor Co.; and Friesen et al U.S. Pat. No. 4,220,050 issued Sep. 2, 1980 to Towmotor Corporation.

However, the known external lock-out mechanisms suffer from ergometrical shortcomings and are generally aesthetically undesirable for use in modern machines. Known hydraulic lock-out systems have the shortcoming that they do not provide tactile feedback of the locked-out condition. And, separate lock-out levers or other actuators require the operator to remove his or her hand from the lever being locked-out and visual identification of the lock-out lever or other actuator when performing the lock-out function.

Another shortcoming of a wide variety of known lock-out mechanisms is that they have failure modes that can go undetected and result in the control lever being in an unknown operating condition. Still another shortcoming of various known lock-out mechanisms is a lack of adaptability for use with control levers having curved shapes.

Accordingly, the present invention is directed to overcoming one or more of the problems as set forth above.

DISCLOSURE OF THE INVENTION

In one aspect of the present invention, a control lever assembly with handle lock-out capability is disclosed. The present control lever assembly includes a moveable base having a detent receptacle at a predetermined location thereon, and a lever element having a first end mounted for pivotal movement to the base and an opposite second or free end, the lever element including a passage extending therethrough between a first opening adjacent the first end thereof and a second opening adjacent the second end thereof. The control lever assembly includes a detent element extending through the passage of the lever element, the detent element having a first end portion positioned adjacent the first end of the lever element and a second end portion positioned adjacent the second or free end thereof, the lever element being pivotally movable to a locking position with the first end portion of the detent element located in alignment with the detent receptacle, the first end portion of the detent element being cooperatively receivable in the detent receptacle to lock the lever element to the base in the locking position. A first biasing member is disposed on the lever element and is operable to exert a first biasing force against the detent element to urge the first end portion thereof toward the base and into the detent receptacle when located in alignment therewith. A handle is mounted to the second or free end of the lever element for movement relative thereto between a first or lock position and a second or unlock position, the handle and lever element including cooperatively engageable members operable to hold the handle in at least the first or lock position until manually released therefrom. The present control lever assembly further includes a second biasing member disposed adjacent the second or free end of the lever element and operable in cooperation with the handle when in the second or unlock position to exert a second biasing force against the detent element in opposition to and greater than the first biasing force to withdraw and hold the detent element from the detent receptacle to allow free pivotal movement of the lever element relative to the base.

In a preferred aspect of the present invention, the portion of the detent element extending through the passage of the lever element is a cable or other flexible member to allow the lever element to have a wide variety of curved and bent shapes.

In another aspect of the present invention, the handle is mounted to the free end of the lever for twisting or rotating movement relative thereto to provide a distinct tactile feeling when moved between the lock position and the unlock position.

BEST MODE FOR CARRYING OUT THE INVENTION

Figure 1:
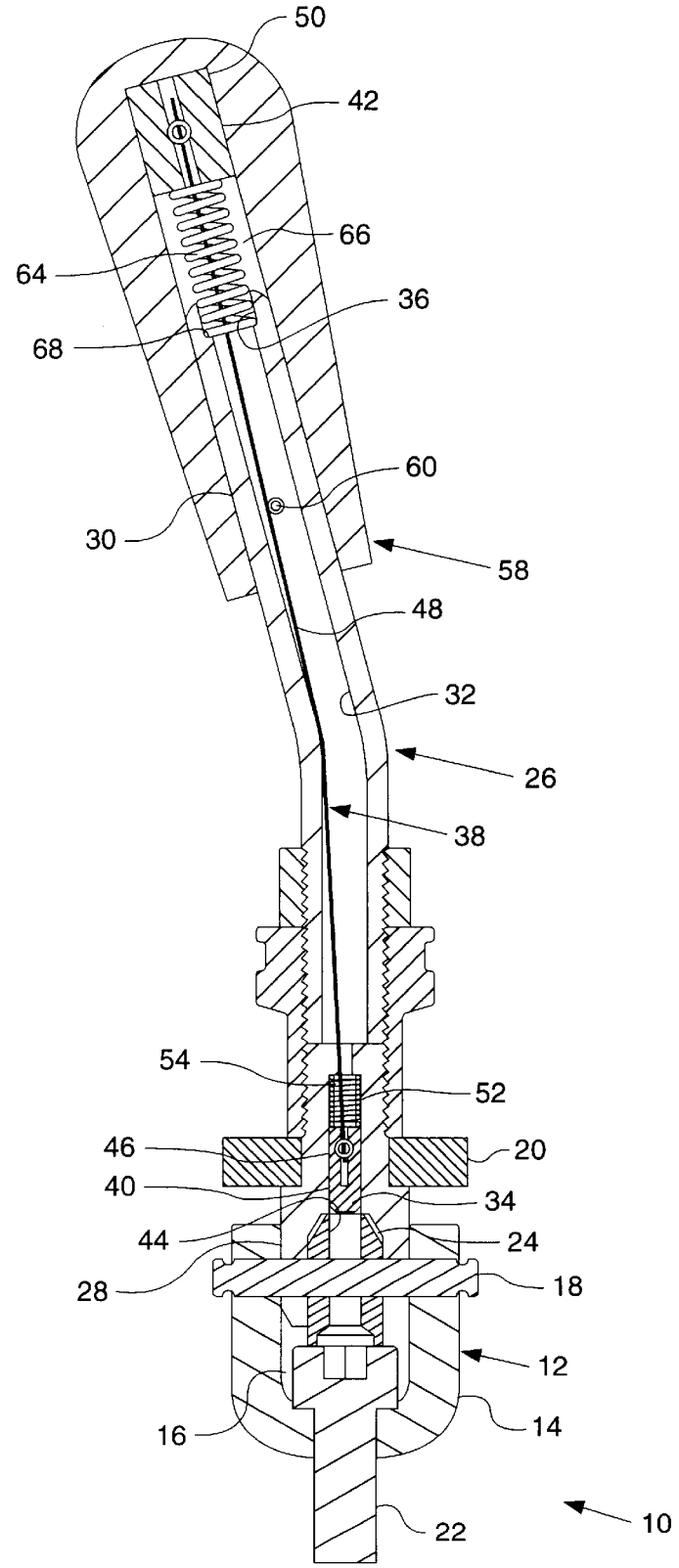
FIG. 1 is a cross-sectional view of a control lever assembly with handle lock-out according to the present invention, showing a handle thereof in an unlock position.

Referring now to the drawings, wherein a preferred embodiment of the present invention is shown, numeral 10 in FIG. 1 refers to a control lever assembly with handle lock-out constructed and operable according to the teachings of the present invention. Control lever assembly 10 is contemplated for use in a wide variety of applications, including, but not limited to, control of hydraulic system valves for performing a wide variety of functions associated with machines used in industrial fields such as construction and excavation, agriculture, mining and forestry. An important feature of the present control lever assembly 10 is the ability to "lock-out" the lever, that is, to lock it in a fixed position to render it inoperable for its intended function, i.e. when the apparatus or system controllable by the lever is to be deactivated or disabled for servicing or other purposes.

Control lever assembly 10 includes a base 12 adapted to be mounted in a fixed position on a floor, control panel, or other surface in an operator cab or other region of a machine (not shown). Base 12 includes a clevis 14 defining a cavity 16 spanned by a pivot pin 18 located beneath an actuator plate 20. Base 12 includes a bolt 22 for mounting base 12 to a floor or other surface, and a cam 24 mounted to bolt 22 at a central location in cavity 16, pivot pin 18 passing through cam 24 as shown.

Control lever assembly 10 includes a lever element 26 having a first end 28 and an opposite free end 30. First end 28 of lever element 26 extends into cavity 16 of base 12 and is mounted for pivotal movement in a direction corresponding to into and out of the page relative to base 12 about pivot pin 18 to move actuator plate 20 for selectively operating one or more spool valves (not shown). Lever element 26 includes a passage 32 extending therethrough between a first opening 34 adjacent first end 28 and a second opening 36 adjacent free end 30.

A detent element 38 extends through passage 32 of lever element 26. Detent element 38 includes a first end portion positioned adjacent first end 28 of lever element 26, and a second end portion 42 positioned adjacent free end 30 thereof. First end 28 of lever element 26 is pivotally moveable about pivot pin 18 in closely spaced relation to cam 24 of base 12. Cam 24 additionally includes a detent receptacle 44 positioned and oriented so as to be in alignment with first opening 34 of lever element 26 when located in a generally upright orientation as shown. First opening 34 has a generally cylindrical shape, detent receptacle 44 having a corresponding cylindrical shape.

Figure 2:
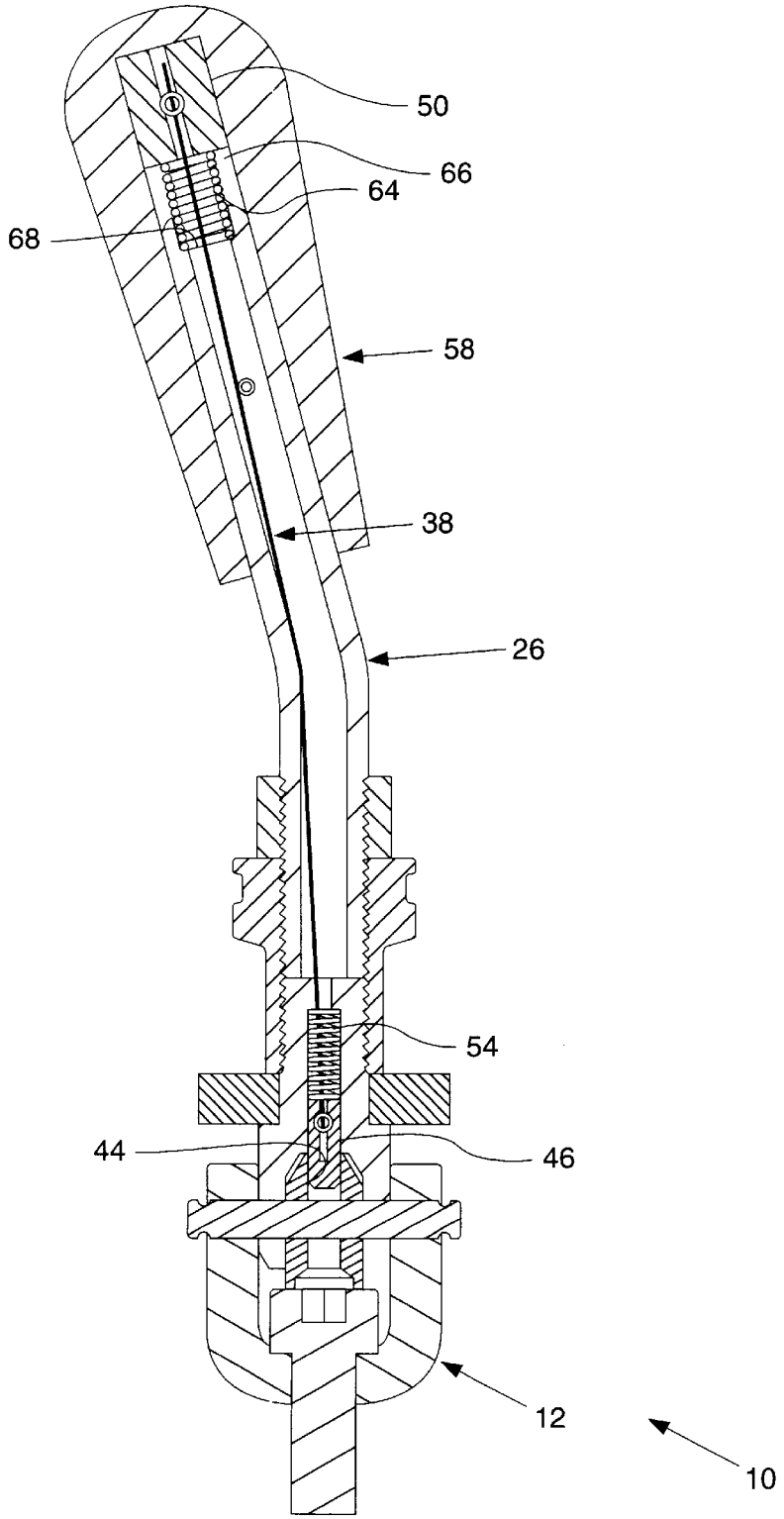
FIG. 2 is a cross-sectional view of the control lever assembly of FIG. 1, showing the handle thereof in a lock position.

First end portion 40 of detent element 38 includes a cylindrical shaped detent pin 46 cooperatively received in first opening 34 of lever element 26, detent pin 46 being cooperatively receivable in detent receptacle 44 when located in aligned registration therewith so as to be located partially within first opening 34 and detent receptacle 44, as best shown in FIG. 2.

Detent element 38 includes a cable portion 48 extending between detent pin 46 of first end portion 40 thereof, and second end portion 42 thereof which includes a cable anchor 50 affixed to cable portion 48.

First end 28 of lever element 26 includes an annular shoulder 52 extending around passage 32 at its juncture with first opening 34. A first biasing member 54 is located in first opening 34 between detent pin 46 and shoulder 52. The preferred first biasing member 54 is a compression coil spring shown in a compressed state, and is operable to exert a first biasing force against detent pin 46 and thus against detent element 38 to urge detent pin 46 toward base 12 and into detent receptacle 44 when located in aligned registration therewith.

Control lever assembly 10 includes a handle 58 mounted to free end 30 of lever element 26 for rotating movement relative thereto between a first or unlock position as shown, and a second or lock position, as shown in FIG. 2. Lever element 26 includes a locking pin 60 extending transversely therethrough, locking pin 60 being cooperatively received in an L-shaped slot 62 in handle 58 (FIG. 3).

A second biasing member 64 is located adjacent free end 30 of lever element 26 in a cavity 66 of handle 58. Second biasing member 64 is operatively positioned between an annular shoulder 68 extending around free end 30 of lever element 26, and cable anchor 50 which is also located in cavity 66. Second biasing member 64 is preferably a compression coil spring and is operable to exert a second biasing force against detent element 30 via cable anchor 50 in opposition to, and greater than, the first biasing force exerted by first biasing member 54, to withdraw and hold detent pin 46 of detent element 38 from detent receptacle 44 as shown, to thereby allow free pivotal movement of lever element 26 relative to base 12 when handle 58 is in the unlock position.

Referring to FIG. 2, control lever assembly 10 is shown with handle 58 thereof in the lock position. In the lock position, handle 58 operates against cable anchor 50 of detent element 38 to compress compression coil spring against shoulder 68, such that the second biasing force is relieved. This allows the compression coil spring to decompress and exert the first biasing force against detent pin 46 such that, when located in aligned registration with detent receptacle 44 as shown, detent pin 46 is received therein to thereby lock lever element 26 in a upright or locking position to base 12.

Figure 3:
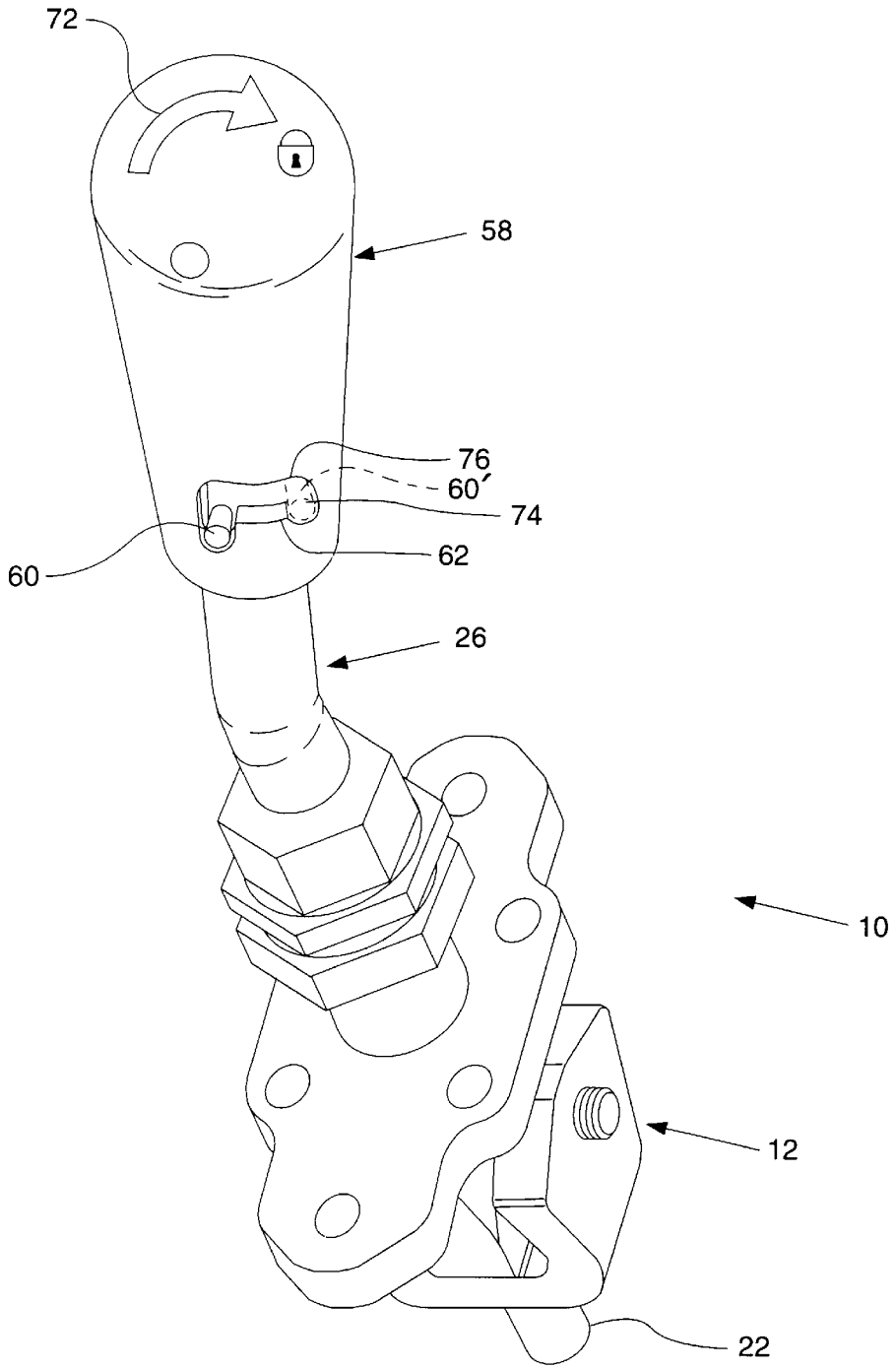
FIG. 3 is a perspective view of the control lever assembly of FIG. 1 showing cooperatively engageable members operable to hold the handle in the lock position and in the unlock position.

Referring to FIG. 3, handle 58 of assembly 10 is moveable from the unlock position (FIG. 1) to the lock position (FIG. 2) by rotating in the clockwise direction denoted by arrow 72 while simultaneously being pushed in the direction of base 12, to guide locking pin 60 through slot 62 to a locked position shown at 60' (in phantom) cooperatively engaged with a sidewall portion 74 of handle 58 in a seat 76 of slot 62. Then, to return handle 58 to the unlock position, the handle is pushed to disengage locking pin 60 from seat 76 and rotated fully in the counterclockwise position and released. In the locked position an operator is able to easily determine and verify the locked condition by visually checking the upright position of lever element 26, indicia on handle 58 such as arrow 72, and the position of locking pin 60 in slot 62. Additionally, the operator can grasp handle 58 or lever element 26 to attempt to move the lever element from its upstanding locking position, and can attempt to rotate handle 58 in the locking direction to verify the locked condition. Further, in the event of failure conditions, such as breakage of cable portion 48 or spring 70, detent pin 46 will enter detent receptacle 44 when lever element 26 is rotated into its locking position, thus providing operator feedback that the failure condition exists. Still another advantage of the present control lever assembly 10, as a result of the flexibility of cable portion 48 of detent element 38, is the ability of lever element 26 to have a wide variety of different shapes, including a bent shape (shown) or S-shape, as desired based on ergometric considerations and the like.

INDUSTRIAL APPLICABILITY

The present control lever assembly with handle lock-out has utility for use in a wide variety of applications wherein a positive lock-out capability for preventing inadvertent and accidental actuation of a system controlled thereby is required. The present assembly has particular utility for controlling critical functions of machines utilized in such industrial fields as agriculture, construction and excavating, mining, forestry, and the like.

Other aspects, objects and advantages of the present invention can be obtained from a study of the drawings, the disclosure and the appended claims.

What is claimed is:

1. A control lever assembly comprising:

a base having a detent receptacle at a predetermined location thereon;

a lever element having a first end mounted for pivotal movement relative to the base and an opposite free end, the lever element including a passage extending therethrough between a first opening adjacent the first end thereof and a second opening adjacent the free end thereof;

a detent element extending through the passage of the lever element, the detent element having a first end portion positioned adjacent the first end of the lever element and a second end portion positioned adjacent the free end thereof, the lever element being pivotally movable to a locking position with the first end portion of the detent element located in alignment with the detent receptacle, the first end portion of the detent element being cooperatively receivable in the detent receptacle to lock the lever element to the base in the locking position;

a first biasing member disposed on the lever element and operable to exert a first biasing force against the detent element to urge the first end portion thereof toward the base and into the detent receptacle when located in alignment with the detent receptacle;

a handle mounted to the free end of the lever element for movement relative to the lever element between a lock position and an unlock position, the handle and the lever element including cooperatively engagable members operable to hold the handle in at least the lock position until manually released therefrom, the handle when in the unlocked position being operable to hold the detent element from the detent receptacle to allow free pivotal movement of the lever element relative to the base.

2. The control lever assembly, as set forth in claim 1, wherein the handle is rotatable relative to the lever between the lock position and the unlock position, and the cooperatively engageable members include a pin moveable through a slot as the handle is moved, the slot including a seat portion wherein the pin is receivable to hold the handle in the locked position.

3. The control lever assembly, as set forth in claim 1, wherein the detent element comprises a cable portion extending through the passage of the lever element, and the first end portion of the detent element comprises a detent pin affixed to the cable portion and cooperatively receivable in both the first opening of the lever element and the detent receptacle of the base.

4. The control lever assembly, as set forth in claim 3, wherein the first biasing member comprises a compression coil spring located in the first opening of the lever element inwardly of the detent pin.

5. The control lever assembly, as set forth in claim 1, further comprising:

a second biasing member disposed adjacent the free end of the lever element and operable in cooperation with the handle when in the unlock position to exert a second biasing force against the detent element in opposition to and greater than the first biasing force to withdraw and hold the detent element from the detent receptacle to allow free pivotal movement of the lever element relative to the base.

6. The control lever assembly, as set forth in claim 5, wherein the handle and the second opening adjacent the free end of the lever element comprise a cavity adapted for cooperatively receiving and holding the second biasing member.

* * * * *